United States Patent [19]

White et al.

[11] 4,089,265

[45] May 16, 1978

[54] FLEXOGRAPHIC PRINTING ROLL AND MEANS FOR ASSEMBLING SAME

[75] Inventors: William Paul White, Ellesmere Port; Michael William James Lewis, Manchester, both of England

[73] Assignee: M. A. Buckley (Engraving) Limited, Woolston, England

[21] Appl. No.: 716,222

[22] Filed: Aug. 20, 1976

[30] Foreign Application Priority Data

| | | |
|---|---|---|
| Aug. 28, 1975 | United Kingdom | 35492/75 |
| Dec. 23, 1975 | United Kingdom | 41814/74 |

[51] Int. Cl.[2] ..... B41F 27/00

[52] U.S. Cl. ..... 101/375; 101/382 MV; 101/378

[58] Field of Search ..... 101/375, 376, 378, 415.1, 101/382 MV; 29/113 R, 446, 427

[56] References Cited

U.S. PATENT DOCUMENTS

| | | | |
|---|---|---|---|
| 2,315,729 | 4/1943 | Nunnally | 101/375 |
| 2,518,834 | 8/1950 | Streckfus et al. | 101/375 UX |
| 2,721,601 | 10/1955 | Spencer | 101/375 UX |
| 2,987,994 | 6/1961 | Allison | 101/375 |
| 3,136,672 | 6/1964 | Prongay | 101/375 |
| 3,146,709 | 9/1964 | Bass et al. | 101/375 |
| 3,378,902 | 4/1968 | Hoexter | 101/375 X |
| 3,878,775 | 4/1975 | Fish | 101/382 MV X |
| 3,978,254 | 8/1976 | Hoexter et al. | 101/375 |

FOREIGN PATENT DOCUMENTS

| | | | |
|---|---|---|---|
| 1,198,863 | 7/1970 | United Kingdom | 101/375 |

*Primary Examiner*—J. Reed Fisher

*Attorney, Agent, or Firm*—Larson, Taylor and Hinds

[57] ABSTRACT

A flexographic printing roll comprising a rigid base tube having perforations in the form of a plurality of small apertures and a circumferentially stretchable, elastomeric, seamless printing sleeve on said tube strained to grip the tube to retain the sleeve securely on the tube; in which there is provided means on the tube to aid the sliding of the sleeve on the tube. The said means may comprise a circumferential seal which can be pressurized to press on the sleeve and expand it. The said means may comprise an expandable metal segment seal. The said means may comprise a tapering sleeve through which means are provided for applying reducing pressures at points along the surface of the tapering sleeve.

6 Claims, 5 Drawing Figures

10e
10d
10
10b
10c 17b
17a
17

12
16e
16d
11
10b
10
17
10c
11
10a
10b
16
d
13
13a
14
15
17
12
20a
20a

FLEXOGRAPHIC PRINTING ROLL AND MEANS FOR ASSEMBLING SAME

BACKGROUND OF THE INVENTION

This invention relates to flexographic printing.

In U.S. Application Ser. No. 615,509 (Inventor: Stanley Fellows), assigned in common with the present application to M. A. Buckley (Engraving) Limited, there is described the concept of forming a flexographic printing roll by the technique of applying a circumferentially stretchable, elastomeric, engraved, seamless sleeve to a rigid tube, the sleeve being expanded by air pressure as it is applied to the tube. The base tube has perforations in the form of small apertures and shallow external grooving extending away circumferentially from said apertures.

Various arrangements (some of which are referred to in the said U.S. application Ser. No. 615,509 and invented by the present applicants whilst under contract to said common assignees) were found advantageous to aid the fitting of the sleeve to the tube. These arrangements together with one further arrangement are the subject of the present application.

SUMMARY OF THE INVENTION

In a flexographic printing roll comprising a rigid base tube having perforations in the form of a plurality of small apertures and a circumferentially stretchable, elastomeric seamless printing sleeve on said tube strained to grip the tube to retain the sleeve securely on the tube; there is provided means to aid the sliding of the sleeve on the tube.

The said means may comprise a tube end attachment which has means permitting its pressurisation to stretch the sleeve circumferentially as it is applied to or withdrawn from the tube.

The said attachment may comprise a spigot and circumferential seal with the spigot perforated to allow pressure inside the tube to reach the seal so that the space defined between the seal, the sleeve end, and the base tube end can be pressurised to stretch the sleeve end.

In another form the attachment may comprise a circumferential seal and the attachment is perforated to allow pressure inside the base tube to reach the seal so that the seal can be expanded to press on the sleeve end and thereby stretch it.

In yet another form the attachment may comprise an expandable circumferential metal segment seal and the attachment is perforated to allow pressure inside the tube to reach the sleeve and expand it.

In yet another form the attachment is in the form of a tapered sleeve through which means are provided for applying reducing pressures at points along the surface of the sleeve in the direction of the sleeve taper.

DESCRIPTION OF THE PREFERRED EMBODIMENTS

Figures 1, 1A, 1B:
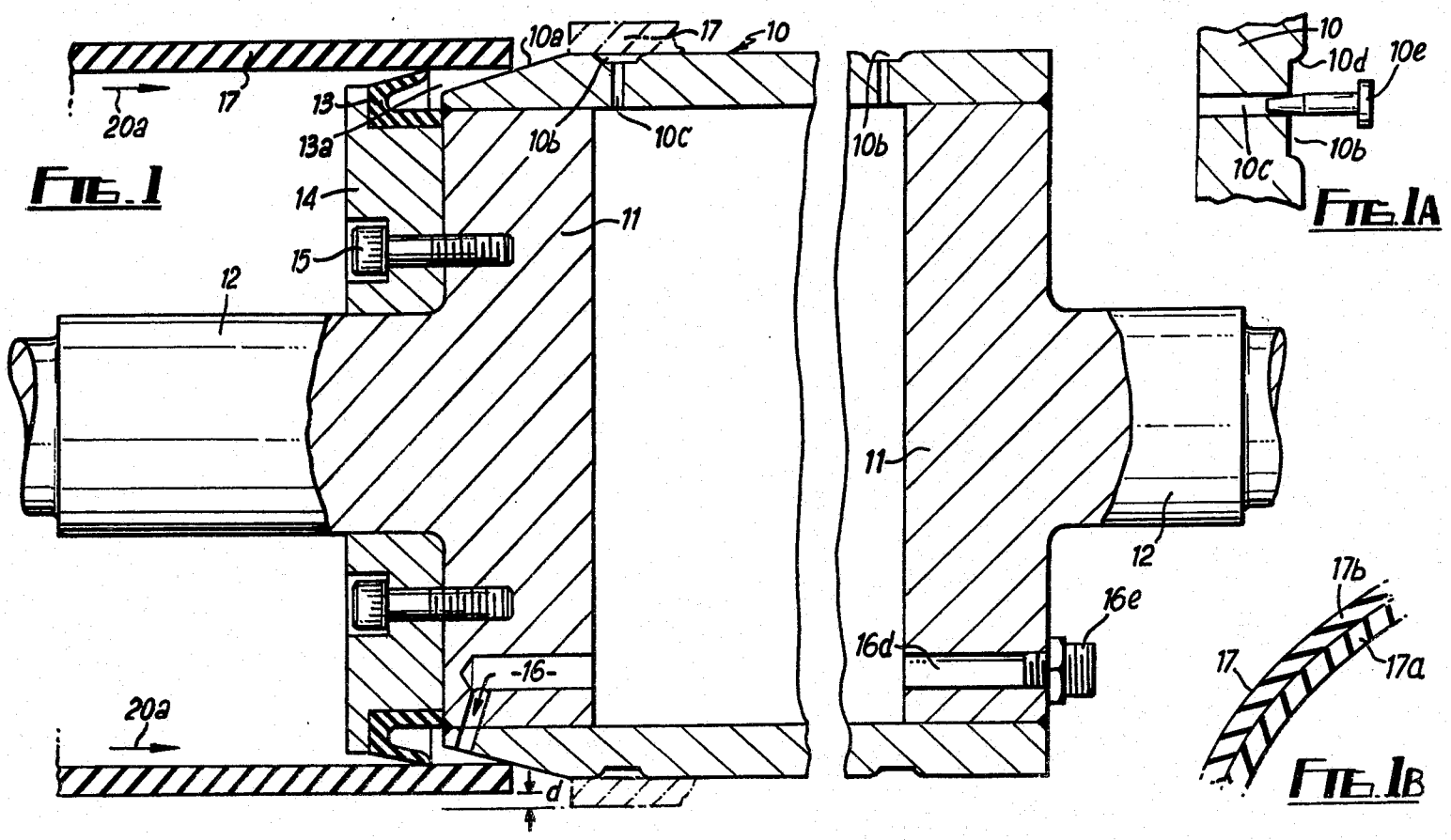
FIG. 1 is a sectional elevation of a tube end with means to aid the sliding of a sleeve on the tube, according to the present invention.
FIG. 1A is a fragmentary sectional view of a part of FIG. 1.
FIG. 1B is a fragmentary sectional view of the sleeve of FIG. 1.

In FIG. 1 a base tube is shown comprising a steel tube 10 with end spigots 11 and trunnions 12. The tube 10 has a conical end 10*a*. One spigot 11 carries a flexible lip seal 13 held in place by a plate 14 and screws 15. This spigot 11 and the end of the tube 10 have a passageway 16. A circumferentially stretchable seamless printing sleeve 17 is shown (full line) with one end about to be fitted on the base tube 10. The sleeve 17 is also shown in dash line fitted on the tube 10 and the radial strain to which the sleeve has been subjected is indicated by the dimension *d*. This may typically be 1.5 mm.

The tube 10 has a series of spaced circumferential grooves 10*b* on its outer surface and each one of these grooves is connected to the inside of the base tube 10 by a single hole 10*c* of 1.5 mm diameter. The grooves 10*b* have curved edges 10*d*, detail of which is shown in FIG. 1A. The grooves 10*b* are typically located at 25 mms from the ends of the tube 10 and at about 30 cms spacing along the length of the tube 10. The depth of the grooves is 0.75 mm and their width is 6 mm. The dimension and spacing of the grooves can be modified according to parameters of the tube 10. Plugs 10*e* are shown inserted in the holes 10*c* in FIG. 1A.

As shown in FIG. 1B the sleeve 17 comprises a rubber core tube 17*a* of 4.5 mm wall thickness and an outer tube 17*b* bonded to tube 17*a*. The tube 17*a* provides the necessary stiffness to the sleeve 17 and the tube 17*b* provides a surface which is suitable for engraving to create a pattern or suitable for carrying stereos.

The stiffness of the sleeve 17 is such that it can be handled and fitted to the base tube 10 without undue distortion. One test of adequate stiffness is that the sleeve 17 should be capable of supporting itself when stood on end without leaning over and without bulging at the lower end. The sleeve 17 should have good stress relaxation properties so as to remain strained for a long period whilst giving a firm grip on the base tube 10.

The other spigot 11 of the tube 10 has a passageway 16*d* terminating at a union 16*e* so that the inside of the tube 10 can be pressurised.

To fit the sleeve 17 to the tube 10 all holes 10*c* are plugged with plugs 10*e* and the plate 14 and seal 13 are attached to one spigot 11 and a supply of compressed air (from 5 to 15 p.s.i.g.) is connected to union 16*e*. The seal 13 is sprayed with P.T.F.E. to reduce friction. The sleeve 17 is applied over the seal 13 and moved axially as indicated by arrows 20*a* to reach the conical part 10*a* of tube 10. At this point the space 13*a* between seal 13, end of sleeve 17 and end of tube 10 become pressurised. This has two effects. The lip of seal 13 is kept pressed against the sleeve 17 and a radially outward force is exerted on the end of sleeve 17 so that it can move over the conical part 10*a* and fit on to the tube 10. As the sleeve 17 moves over the tube 10 so the plugs 10*e* are progressively removed from holes 10*c*. This can be done manually or by the sleeve hitting the plugs. As the plugs are removed so pressure in the tube 10 reaches the grooves 10*b*. This also has two effects. It maintains the strain in the sleeve 17 and it acts as lubricant as the sleeve is fitted on the base tube.

As the sleeve 17 moves clear of the seal 13 there will be a small fall of pressure inside the tube 10 because of air escape via passageway 16. This pressure fall is not significant as the passageway 16 intentionally has a constriction of small diameter (such as 0.7 mm) as its end opening at the part 10*a*. The gradual fall in pressure is important as it allows stresses in the sleeve to equalise so that localised compression and tensioning of the sleeve is avoided and so that the sleeve can contract to a constant size when it is fitted.

When the sleeve 17 is fully fitted on the tube 10 the compressed air supply is turned off and a pressure difference change takes place gradually across the wall of the sleeve and the sleeve 17 comes into contact with the tube 10 and grips it securely. In due course the air supply at union 16*e* is removed. It is of interest to note that the pressure required to cause the sleeve to lift from the tube is preferably about 5 p.s.i.g.

Figure 1C:
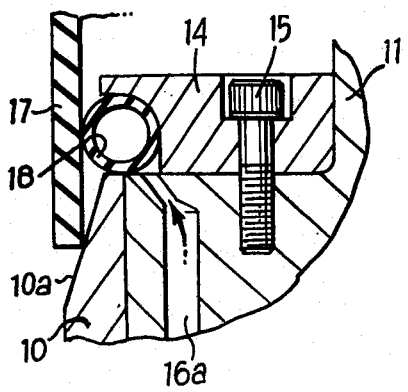
FIG. 1C is a fragmentary sectional view of a modification of the arrangement shown in FIG. 1.

In an alternative seal arrangement, shown in FIG. 1C the lip seal 13 is replaced with an elastomeric ring 18 and the passageway 16*a* through the spigot 11 is arranged to terminate so as to expand the ring 18 when air pressure is supplied to the passageway. In this way the ring 18 acts both as a seal and a means of applying a stretching force to the end of sleeve 17. Again, the ring 18 is preferably lubricated with a P.T.F.E. spray.

Figure 1D:
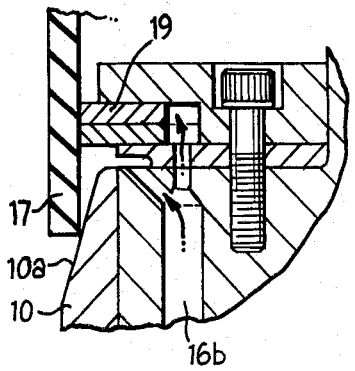
FIG. 1D is a fragmentary sectional view of a further modification of the arrangement shown in FIG. 1.

In another alternative arrangement, shown in FIG. 1D, an iris type pneumatically expandable seal 19 is shown and the passageway 16*b* terminates radially inwardly of the seal 19 to expand it and also pressurises the end of the sleeve 11. The seal 19 could also be spring-loaded to seal. This arrangement has the advantage that there is no requirement for the seal 19 to engage the sleeve 17 forcefully and hence friction can be lower.

As an alternative to using P.T.F.E. to reduce friction between seals 13, 18 and 19 and sleeve 17 and between the end of sleeve 17 and tube 10, water can be used as a lubricant. This could be brought about by using moist compressed air initially to allow fitting followed by heated dry compressed air to remove all traces of moisture.

Preferably the surface of the base tube 10 is smooth (apart from grooving like grooving 26) and the sleeve 17 engages the tube 10 solely by friction. However for certain applications it may be necessary to provide some form of key between sleeve and tube as, in use, a stress wave is generated continuously ahead of the roller contact area and this tends to make the sleeve creep round the base tube although this tendency is reduced to some extent where the sleeve is of soft material (40°–80° and preferably 50°–55° Shore) and of significant thickness (3 mm) since the stress wave can decay within the soft material.

The material for sleeve 17 has to be selected with problems of thermal expansion in mind. The invention has use world-wide and hence considerations must be given to use where ambient temperatures can change, by up to as much as 40° C in a few hours. Elastomers and plastics exhibit high co-efficients of thermal expansion compared with steel and so temperature changes would cause tightening or slackening of the sleeve on the steel base tube. Consequently the amount of strain in the fitted sleeve 17 and its mechanical properties, particularly its stress relaxation, are all design considerations.

The sleeve 17 can be temperature acclimatised before fitting to the base tube 10. Typically it would be acclimatised in a temperature controlled room to about the mid-point of the temperature range in which it is to operate.

The sleeve 17 could be lined with a permeable stretchable material, such as a fabric to allow air from holes 10*c* in the tube 10 and from grooves 10*b* to percolate over the whole inner surface of the sleeve during fitting.

The choice of sleeve parameters are considered to lay within a fairly well defined band. For example the thickness should be in the range of 1.5 mm to 8 mm. The hardness should be in the region of 85° Shore. The diametral interference in the sleeve for a 15 cm diameter roller could typically be 3 mm to give a strain of about 2.2% when fitted to the base tube. Young's Modulus of the sleeve could be in the range of 16,000 lbs/in$^2$ for a 6 mm thick sleeve to 64,000 lbs/in$^2$ for a 1.5 mm thick sleeve. A pressure of 30 lbs/sq.in could be used for straining the tube during fitting.

Sleeve materials also have to be chosen with resistance to inks and cleaning fluids in mind. In general rubbers are preferred such as natural rubber cross-linked to give the required hardness and unfilled or styrene-butadiene rubber. Nitrile rubber is advantageous in that it has a high resistance to oil-based inks. Polyurethane rubber also has many attractive properties but has a higher cost. Ethylene propylene diene monomer (E.P.D.M.) may also be used.

Thus it is seen that the invention provides a method of setting up and taking down flexographic printing rolls for plural patterns comprising having one set of rigid base rolls and plural sets of flexographic printing sleeves said method comprising sliding one set of sleeves of one pattern over said set of rigid base rolls and causing a pressure difference change across the walls of the sleeves whereby the sleeves take on a strain to grip the base rolls to retain the sleeves securely on the base rolls and, after printing, causing a reverse pressure difference change across the walls of the sleeve, whereby the sleeves are released from the base rolls, and sliding said set of sleeves from said set of base rolls.

In this way it is possible to set up and take down a pattern and then set up other selected new patterns whilst using base tubes common to all patterns.

Figure 2:
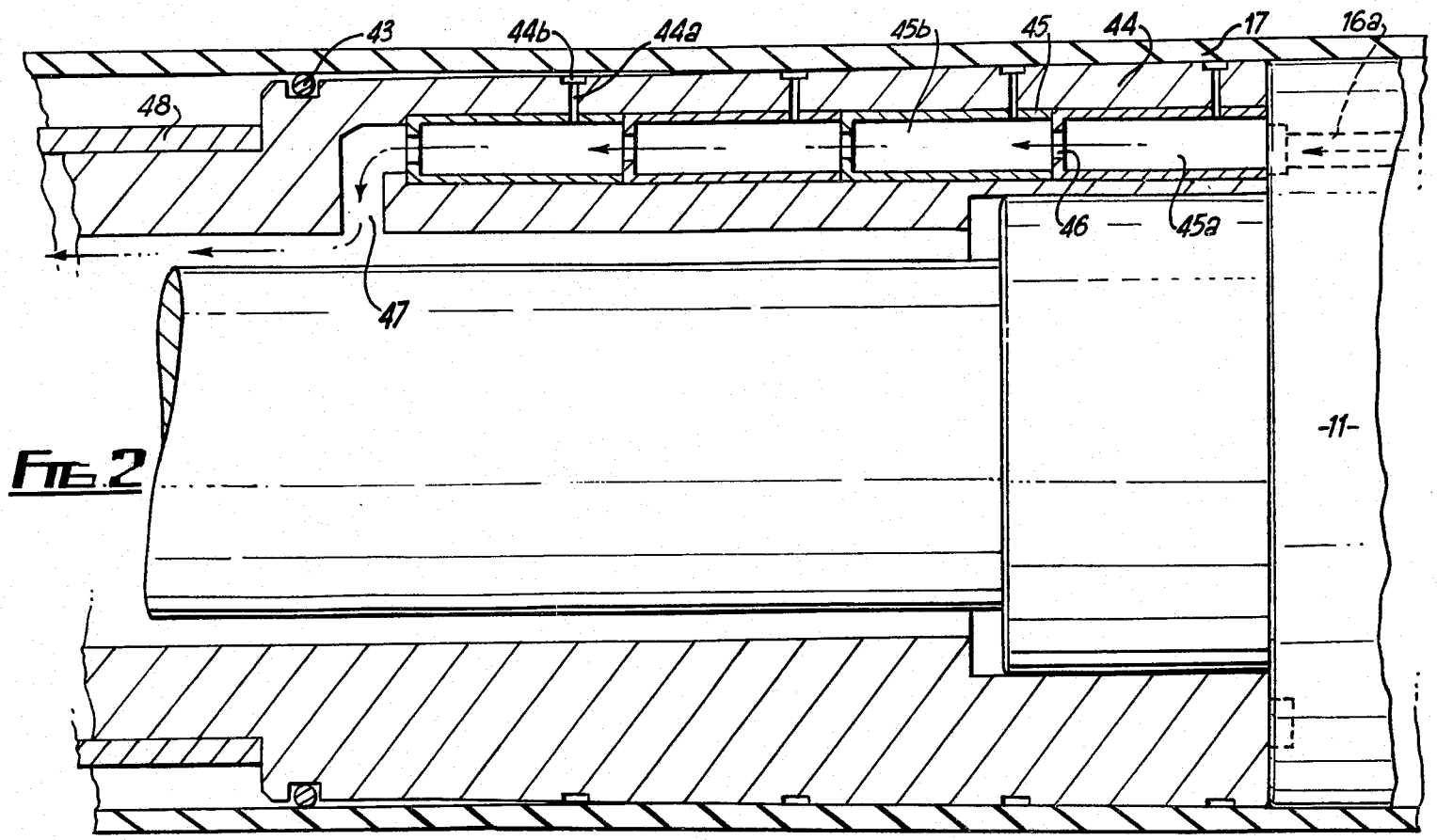
FIG. 2 is a view as FIG. 1 but showing a further means to aid the sliding of a sleeve on a tube.

FIG. 2 shows a seal arrangement which reduces the friction problem which can arise between seal and sleeve during the fitting of the sleeve.

An end fitting sleeve 44 is provided which seals against the end spigot 11 of the base tube. The sleeve 44 has a tapered external surface (about 1° taper) and at the end of the taper a P.T.F.E. O-ring seal 43 is provided to seal between sleeve 44 and sleeve 17. At various points along the taper, radial bores 44*a* are provided which, at their outmost extremity, connect with circumferential grooves 44*b* and at their innermost extremity with a pressure reducing manifold 45. The manifold has sections 45*a*, 45*b* etc. which are interconnected by pressure reducing orifices 46. Each section has a respective bore 44*a*. The manifold connects with passageway 16*a* through spigot 11 and discharges to a passageway 47 and thence to atmosphere. A support tube 48 is used to retain the sleeve 44 in position.

Since rubber is substantially incompressible its volume remains constant and hence and expanded rubber sleeve 17 will experience a small reduction in wall thickness (typically 0.050 mm) but a significant reduction in length (typically 20 mm on a 180 cm length sleeve). This change of length can be significant in flexographic printing as pattern registration can be affected. For this reason, the gradual release of pressure on the sleeve as referred to above is important. Where length becomes very critical, either during fitting or with temperature changes, flanges can be provided on the base tube so that a degree of precompression exists in the sleeve. Change in wall thickness is not so critical as the amount is small and the sleeve can be ground to size before use.

The desired properties of the sleeve 17 material, in relation to its fitting on the base tube 10 are: a stress relaxation rate lower than 10% per decade, good recovery properties (i.e. rapid return to its orginal dimensions after removal from the roller) and good compression set resistance (i.e. no permanent deformation). Soft natural rubbers offer good properties in this respect.

As the pressure required to just lift a fitted sleeve 17 from a base roll 10 is a measure of the strain in the sleeve and hence the grip of sleeve on base tube, it is recommended that this pressure should be in the range of 4–7 lb. f/in$^2$. Whilst this figure could be reached by suitably increasing the Young's Modulus of the material this is not generally advised because it tends to result in poorer time-dependent elastic properties of the materials. Preferably the figure should be reached by either increasing the wall thickness of the sleeve or by increasing the diameter strain.

The means to aid sliding of the sleeve on the base tube are removed once the sleeve is on the tube and are replaced when the sleeve has to be removed from the tube.

We claim:

1. In a flexographic printing roll comprising a rigid base tube having perforations in the form of a plurality of small apertures and a circumferentially stretchable printing sleeve on said tube strained to grip the tube to retain the sleeve securely on the tube; means on one end of the base tube to aid the sliding of the sleeve on the tube, said means comprising apparatus having aperture defining means extending from the inside of the base tube to a point external of the base tube that is not covered by the sleeve when fitted whereby a localized pneumatically applied circumferential strain can be created in the sleeve progressively by pressure in said aperture defining means acting on the sleeve as the sleeve is slid on the tube.

2. A printing roll as claimed in claim 1 in which said apparatus comprises a spigot and a flexible lip seal, the spigot having aperture defining means to present pressure inside the tube to the lip seal to expand the seal into sealing engagement with the inside of said sleeve as the sleeve is slid on the tube.

3. A printing roll as claimed in claim 1 in which said apparatus comprises a spigot and a flexible ring seal having aperture defining means to present pressure inside the tube to the ring seal to expand the seal into sealing engagement with the inside of said sleeve as the sleeve is slid on the tube.

4. A printing roll as claimed in claim 1 in which said apparatus comprises a spigot and an end fitting sleeve, said end fitting sleeve having a tapered external surface and means defining a manifold therein having pressure reducing orifices, and means defining passageways from the manifold to said external surface whereby a progressively increasing pneumatically applied strain can be created in the sleeve as the sleeve approaches the tube end.

5. A printing roll as claimed in claim 1 wherein said aperture defining means includes constriction means whereby a gradual fall in pressure can take place in said base tube and hence create a gradual decrease in the pneumatically applied strain in the sleeve when said sleeve has become fully slid on the base tube.

6. A printing roll as claimed in claim 1 in which said means on said one end of the base tube includes a seal and in which said point external to the base tube is disposed so that, with the sleeve being fitted, the pressure in the aperture defining means acts in a cavity defined by the sleeve, said means on the end of the base tube and said seal, and, with the sleeve fully fitted, the pressure in the aperture defining means is exposed to ambient.

* * * * *